US005967632A

United States Patent [19]

Lamia

[11] Patent Number: 5,967,632

[45] Date of Patent: Oct. 19, 1999

[54] MOBILE SALON WORK STATION

[76] Inventor: John Lamia, 570 Washington, Grosse Pointe, Mich. 48230

[21] Appl. No.: 09/136,170

[22] Filed: Aug. 19, 1998

[51] Int. Cl.[6] ..... A45D 44/02

[52] U.S. Cl. ..... 312/209; 312/225; 312/249.8; 52/36.1

[58] Field of Search ..... 312/209, 249.1, 312/249.7, 249.8, 249.12, 225, 224, 226, 283, 223.3; 108/50.01, 50.02, 60, 65; 52/36.1

[56] References Cited

U.S. PATENT DOCUMENTS

| | | | |
|---|---|---|---|
| 723,661 | 3/1903 | Evans | 312/209 |
| 724,300 | 3/1903 | Larson | 312/225 X |
| 845,707 | 2/1907 | Randolph | 312/249.8 |
| 1,595,791 | 8/1926 | Lantieri | 312/209 |
| 1,813,821 | 7/1931 | Ruebsahm | 312/209 X |
| 2,703,743 | 3/1955 | Harwood | 312/225 X |
| 3,418,765 | 12/1968 | Propst et al. . | |
| 3,559,352 | 2/1971 | Magnuson . | |
| 3,769,502 | 10/1973 | Schultz et al. . | |
| 3,922,788 | 12/1975 | Rota | 312/209 X |
| 4,002,382 | 1/1977 | Wolf et al. | 312/209 |
| 4,080,022 | 3/1978 | Canfield et al. . | |
| 4,177,612 | 12/1979 | Tochihara . | |
| 4,258,964 | 3/1981 | Cowen, Jr. et al. | 312/209 X |
| 4,332,557 | 6/1982 | Watanabe . | |
| 4,478,467 | 10/1984 | Tyndall . | |
| 4,821,477 | 4/1989 | Rydqvist . | |
| 4,830,614 | 5/1989 | Schricker et al. | 312/209 X |
| 4,840,000 | 6/1989 | Grines . | |
| 4,876,835 | 10/1989 | Kelley et al. . | |
| 5,038,539 | 8/1991 | Kelley et al. . | |
| 5,255,478 | 10/1993 | Baranowski et al. . | |
| 5,282,341 | 2/1994 | Baloga et al. . | |
| 5,291,700 | 3/1994 | Chew . | |
| 5,533,799 | 7/1996 | Nickolaus, Jr. | 312/209 X |
| 5,547,393 | 8/1996 | Jansen . | |
| 5,782,045 | 7/1998 | Paschal | 312/209 X |

FOREIGN PATENT DOCUMENTS

| | | | |
|---|---|---|---|
| 478354 | 12/1915 | France | 312/225 |

*Primary Examiner*—Peter M. Cuomo
*Assistant Examiner*—Hahn V. Tran
*Attorney, Agent, or Firm*—Harness, Dickey & Pierce, P.L.C

[57] ABSTRACT

A mobile salon work station. In an exemplary application, the mobile salon work station includes a frame assembly and work areas equally spaced thereabout having mirrored surfaces, storage compartments, swing out shelves, overhead retractable electrical reels and an overhead accessory holder.

20 Claims, 2 Drawing Sheets

MOBILE SALON WORK STATION

BACKGROUND OF THE INVENTION

1. Technical Field

The present invention generally relates to a mobile salon work station. More particularly, the present invention relates to a mobile salon work station which is self contained, easily transportable, requires a minimal amount of floor space and no leasehold improvements.

2. Discussion

Salons are most frequently set up and conducted as a business in rented buildings or space. In such a highly competitive industry, space is at a premium and there is a continual need for innovation not only in services but also in ambiance. As such, many salons need to relocate often or to redesign the interior floor space of their establishments. The cost of converting a rented building or space into a new salon or remodeling an existing salon is substantial. Generally, such remodeling or renovating of a rented building or space involves structural renovations and the like to the building or space. Such fixtures or improvements cannot be removed when the salon operator terminates his or her lease, or desires to move to another location. Additionally, during such renovations, the salon operator is unable to adequately and fully conduct business. The expense associated with such remodeling is normally very substantial while the effect of such is temporary at best. In the past, there has been no way to minimize this substantial expense while still having a salon that is unique and attractive in appearance. Therefore, it is desirable to have a mobile salon work station which requires a minimum amount of floor space, no leasehold improvements and is entirely moveable to create the effect of remodeling without incurring most of the costs.

SUMMARY OF THE INVENTION

It is a general object of the present invention to provide a mobile salon work station which is easily transportable and virtually self contained. It is another object of the present invention to provide a mobile salon work station which requires a minimum amount of floor space and no leasehold improvements.

It is another object of the present invention to provide a mobile salon work station which requires a single electrical hook up for the entire unit.

It is another object of the present invention to provide a mobile salon work station which can accommodate two (2) stylists and two (2) clients or three (3) stylists and three (3) clients simultaneously while providing an acceptable amount of privacy.

It is another object of the present invention to provide a mobile salon work station which provides numerous storage compartments and display shelves for retail products.

It is a more particular object of the present invention to provide a mobile salon work station which can vary the interior architecture and decorum of the salon establishment to meet changing business conditions, or to improve, upgrade and create a "new look" which is essential in such a highly competitive business such as hairdressing.

It is a related object of the present invention to provide a mobile salon work station which can be configured so as to create numerous possible interior designs or arrangements within the available floor space.

In one form, the present invention provides a portable work station for styling hair. The portable work station includes a frame having a perimeter and work areas equally spaced about the perimeter.

Additional benefits and advantages of the present invention will become apparent to those skilled in the art to which this invention relates from a reading of the subsequent description of the preferred embodiment and the appended claims taken in conjunction with the accompanying drawings.

DETAILED DESCRIPTION OF THE PREFERRED EMBODIMENT

Figure 1:
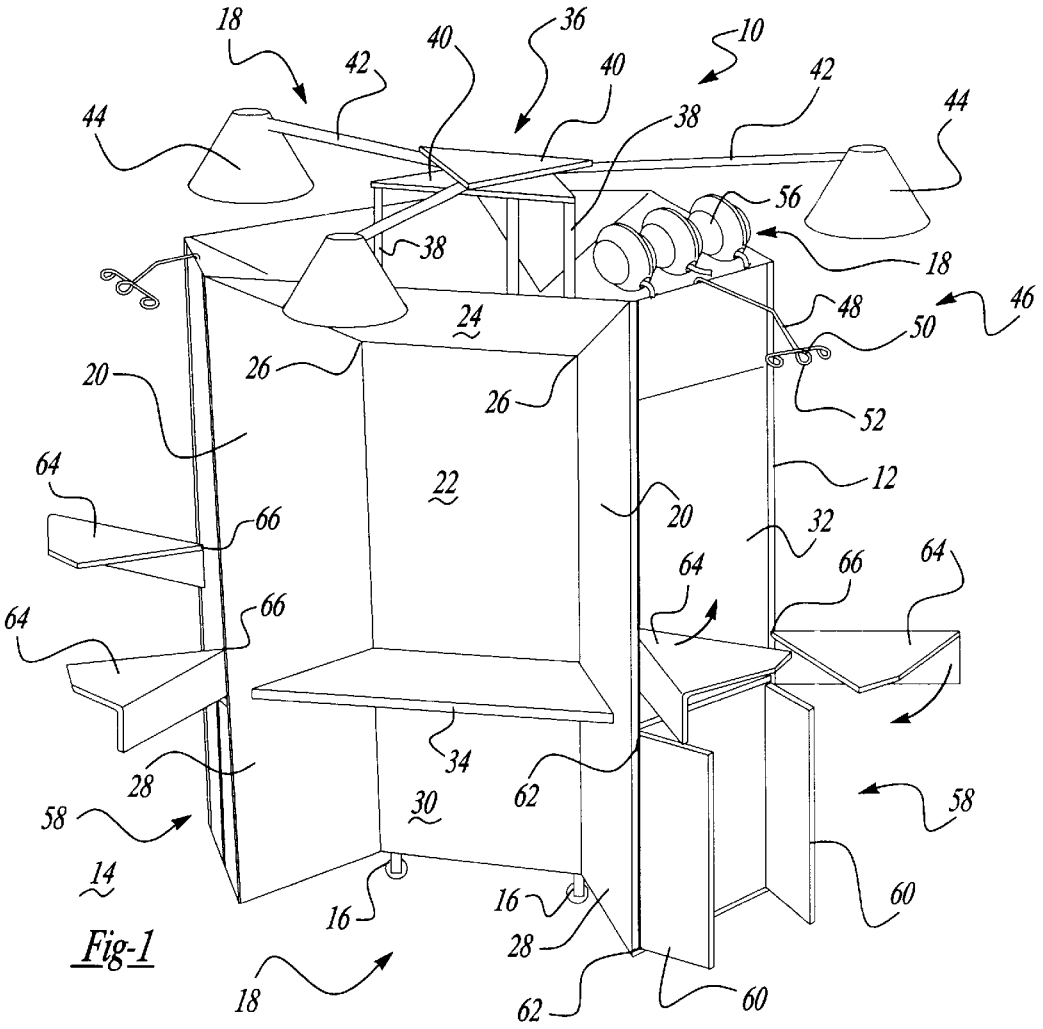
FIG. 1 is a perspective view of a mobile salon work station constructed in accordance with the teachings of a preferred embodiment of the present invention and shown with its storage compartment doors open and its work spaces or display shelves rotated outwardly.

Referring now to the drawings there is depicted a mobile salon work station embodying the concepts of the present invention. The mobile salon work station of the present invention is generally identified in the drawings with reference numeral 10. The mobile salon work station 10 includes a frame assembly 12 supported on a floor 14 by lockable casters 16. The lockable casters 16 allow the mobile salon work station 10 to be easily transported. Other known easily transported and supporting methods in the art may equally be applied for this purpose.

Figure 3:
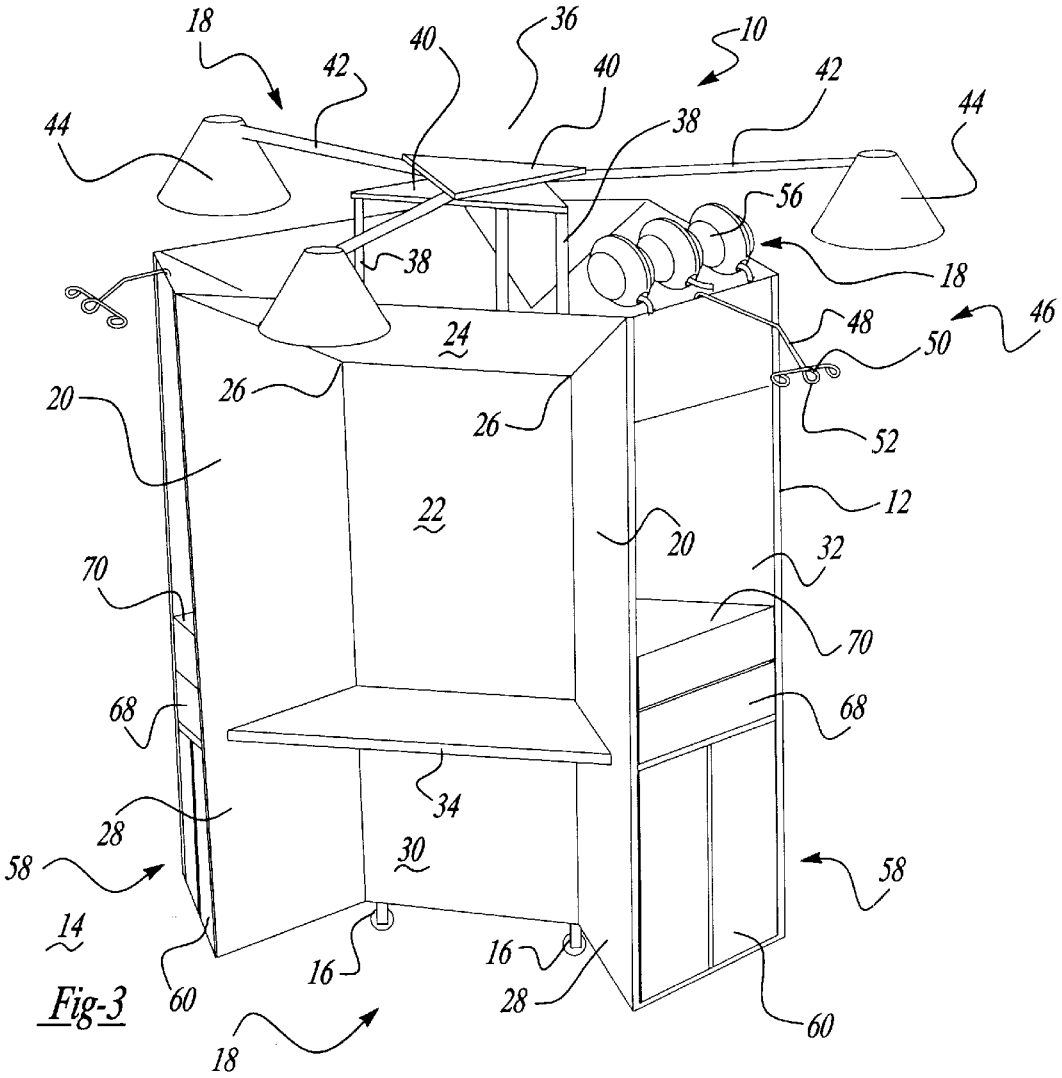
FIG. 3 is a perspective view similar to FIG. 1, illustrating the mobile salon work station of the preferred embodiment of the present invention with its storage compartment doors closed.
Figure 4:
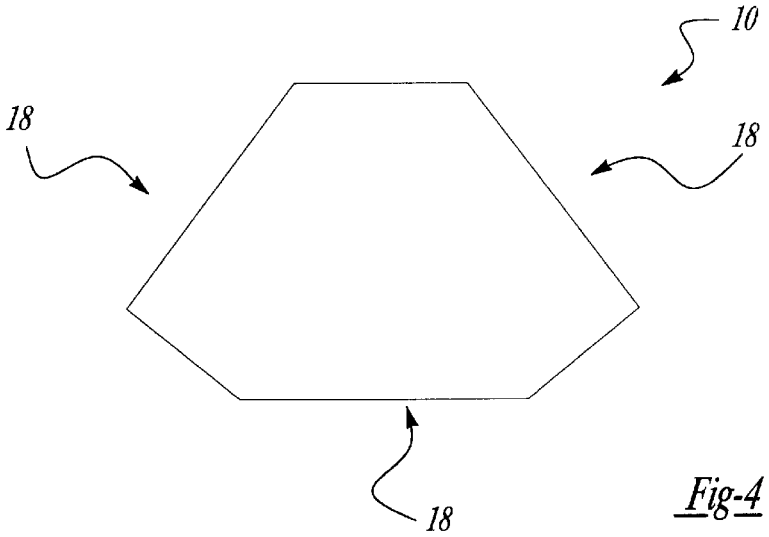
FIG. 4 is a simplified top view illustrating an arrangement of a plurality of work areas of the mobile salon work station.

With particular reference to FIG. 1, FIG. 3 and FIG. 4, the mobile salon work station 10 of the preferred embodiment of the present invention will now be further discussed. As shown most clearly in the simplified top view of FIG. 4, the mobile salon work station 10 defines a plurality of work areas 18. In the preferred embodiment, the mobile salon work station 10 defines three (3) work areas 18. However, it will be appreciated that any number of work areas 18 may be alternatively incorporated. It will be further appreciated that in the preferred embodiment, the work areas 18 are substantially identical and together form a generally hexagonal shape as illustrated in the simplified top view of FIG. 4.

The work areas 18 include side mirrored surfaces 20, a front mirrored surface 22 and a top mirrored surface 24. The side mirrored surfaces 20, the front mirrored surface 22 and the top mirrored surface 24 are all removably secured to the frame assembly 12 of the mobile salon work station 10. Moreover, the top mirrored surface 24 is pivotally secured to the frame assembly 12 thereby pivoting up and down upon pivot points 26. This four (4) mirror system allows the stylist to obtain three (3) or four (4) views of his/her client at a glance while creating and developing the hair style. No hand held mirrors are required. No additional mirrors are required. The work areas 18 further include side panels 28, a front panel 30 and storage compartment panels 32. The side panels 28 and the front panel 30 are removably secured to the frame assembly 12 of the mobile salon work station 10 so that if the interior design of the salon changes, the side panels 28 and the front panel 30 may be removed and replaced so as to match the new decorum of the salon. The side mirrored surfaces 20, the front mirrored surface 22, the side panels 28 and the front panel 30 of the work areas 18 in combination form a relative enclave, allowing a client an adequate amount of privacy in a busy salon. Also secured to the frame assembly 12 of the mobile salon work station 10, between the front mirrored surface 22 and the front panel 30, is a counter 34. The counter 34 is typically made of glass or any other suitable material. The counter 34 allows a client to place his/her glasses, coffee cup or any other item out of the way while enjoying the salon experience.

The mobile salon work station 10 also includes a lighting system 36 which is secured to the frame assembly 12. The lighting system 36 includes support members 38, base support units 40, extension arms 42 and lights 44. The support members 38 of the lighting system 36 are secured at one end to the frame assembly 12 and at an opposite end to the base support units 40. The extension arms 42 of the lighting system 36 are secured at one end to the base support units 40, while the lights 44 are secured at an opposite end thereof. The lights 44 are adjustable and arranged above the work areas 18 so as to provide an optimum amount of lighting for both the stylist and the client.

Figure 2:
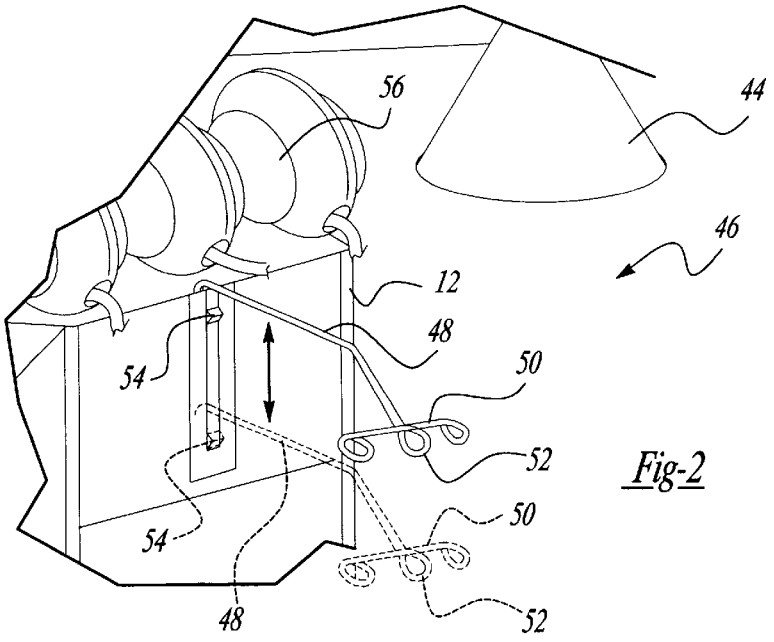
FIG. 2 is an enlarged fragmentary view illustrating retractable electrical reels and an accessory holder both of FIG. 1 and FIG. 3 of the present invention in further detail.

With continued reference to FIG. 1 and FIG. 3, and additional reference to FIG. 2, the mobile salon work station 10 of the preferred embodiment of the present invention is shown to also include an overhead accessory holder assembly 46 which is secured to the frame assembly 12. The overhead accessory holder assembly 46 includes a downwardly projecting arm 48 and a cross member 50. The cross member 50 includes circular members 52 secured thereto. The circular members 52 hold curling irons, hair dryers, and any other such commonly used accessories. As is more clearly shown in FIG. 2, the height of the downwardly projecting arm 48 is adjustable to allow for the varying heights of stylists. A twist lock 54 provides for the easy adjustment of the downwardly projecting arm 48. The overhead accessory holder assembly 46 also includes retractable electrical reels 56 which allow for the electrical cords from the various accessories to be easily retracted. The retractable electrical reels 56 thereby prevent the inadvertent dropping or dangling of the electrical cords of the accessories held in the overhead accessory holder assembly 46, and keeps these cords out of the way of stylists and clients, preventing same from being burned or tripped.

With continued reference to FIG. 1 and FIG. 3, the mobile salon work station 10 of the preferred embodiment of the present invention also includes lower storage compartments 58. The lower storage compartments 58 include outer panel doors 60 which are rotatably mounted to the frame assembly 12 at pivot points 62. The outer panel doors 60 of the lower storage compartments 58 swing outwardly as shown in FIG. 1. The lower storage compartments 58 may be used to store clean and/or soiled towels, a trash receptacle, a dry vacuum cleaner, professional and retail inventory, personal belongings, or any other known items. As with the side panels 28 and the front panel 30, the panel doors 60 are capable of being removed and replaced if and/or when the salon changes decorum.

In the preferred embodiment and the exemplary embodiment illustrated in FIG. 1, the mobile salon work station 10 also includes swing out shelves 64. Swing out shelves 64 are rotatably secured to the frame assembly 12 and rotate about a pivot point 66. The swing out shelves 64 can be used by the stylist as additional work space, or as a place to set combs, brushes, shears, electrical power strips, etc., or as a retail display shelf, or for any other suitable purpose. The swing out shelves 64 are pivotally attached to the frame assembly 12 in a conventional manner and allow the items contained thereon to be closer to and more conveniently retrieved by the stylist.

In the exemplary embodiment illustrated in FIG. 3, the mobile salon work station 10 includes pull out drawers 68 and shelves 70, both secured to the frame assembly 12. As previously discussed with the swing out shelves 64, the pull out drawers 68 and the shelves 70 can include clippers, combs, brushes, shears, retail display items, or any other similarly often used material. An electrical power strip for additional appliances can also be mounted to the shelves 70. Moreover, the lower storage compartments 58, the swing out shelves 64 and the pull out drawers 68 may all include security locks so as to also be used to store personal belongings.

While the above description constitutes the preferred embodiments of the invention, it will be appreciated that the invention is susceptible to modification, variation and change without departing from the proper scope or fair meaning of the accompanying claims.

We claim:

1. A portable work station for styling hair, the work station comprising:

a frame having a hexagonal configuration ,perimeter; and a plurality of work areas spaced about said perimeter, each said work area including a vertically extending mirrored front surface and a pair of mirrored side surfaces outwardly extending from said front surface and oriented at an obtuse angle relative to said front surface, each said work area further including a mirrored upper surface outwardly extending from said front surface, said upper surface pivotally attached to said front surface for pivotal movement a bout a horizontal pivot axis;

wherein said mirrored front surface, said pair of mirrored side surfaces and said mirrored upper surface cooperate to surround a client allowing a stylist to obtain numerous views of said client at a glance.

2. The portable work station of claim 1, wherein said plurality of work areas include at least three work areas.

3. The portable work station of claim 2, wherein said plurality of work areas define a first three sides of a hexagon.

4. The portable work station of claim 3, further comprising a corresponding plurality of storage areas, one said storage area disposed between each adjacent pair of said plurality of work areas.

5. The portable work station of claim 4, wherein said plurality of storage areas define a second three sides of said hexagon.

6. The portable work station of claim 5, wherein said plurality of storage areas comprise at least one swing out compartment rotatably secured to said frame.

7. The portable work station of claim 5, wherein said plurality of storage areas comprise at least one swing out shelf rotatably secured to said frame.

8. The portable work station of claim 5, wherein said plurality of storage areas comprise at least one shelf and at least one pull out drawer both secured to said frame.

9. The portable work station of claim 5, further comprising at least one overhead retractable electrical reel, at least one adjustable overhead accessory holder and an overhead lighting system all secured to said frame.

10. A portable work station for styling hair, the work station comprising:

a frame assembly having a hexagonal configuration perimeter surrounding a common axis; and a plurality of work areas radially arranged about said common axis, each said work area including a vertically extending front surface and a pair of side surfaces outwardly extending from said front surface and oriented at an obtuse angle relative to said front surface, each said work area further including an upper surface outwardly extending from said front surface, said upper surface pivotally attached to said front surface for pivotal movement about a horizontal pivot axis.

11. The portable work station of claim 10, wherein said plurality of work areas include at least three work areas, and further wherein said vertically extending front surface, said pair of side surfaces and said upper surface are all mirrored surfaces.

12. The portable work station of claim 11, wherein said plurality of work areas define a first three sides of a hexagon.

13. The portable work station of claim 12, further comprising a corresponding plurality of storage areas, one said storage area disposed between each adjacent pair of said plurality of work areas.

14. The portable work station of claim 13, wherein said plurality of storage areas define a second three sides of said hexagon.

15. The portable work station of claim 14, wherein said plurality of storage areas comprise at least one swing out compartment rotatably secured to said frame assembly.

16. The portable work station of claim 14, wherein said plurality of storage areas comprise at least one swing out shelf rotatably secured to said frame assembly.

17. The portable work station of claim 14, wherein said plurality of storage areas comprise at least one shelf and at least one pull out drawer both secured to said frame assembly.

18. The portable work station of claim 14, further comprising at least one overhead retractable electrical reel, at least one adjustable overhead accessory holder and an overhead lighting system all secured to said frame assembly.

19. A portable work station for styling hair, the work station comprising:

a frame assembly having a hexagonal configuration perimeter surrounding a common axis; and a plurality of work areas radially arranged about said common axis, each said work area including a vertically extending mirrored front surface and a pair of mirrored side surfaces outwardly extending from said front surface and oriented at an obtuse angle relative to said front surface;

wherein said mirrored front surface and said pair of mirrored side surfaces cooperate to surround a client allowing a stylist to obtain numerous views of said client at a glance.

20. The portable work station of claim 19, further comprising a corresponding plurality of storage areas, one said storage area disposed between each adjacent pair of said plurality of work areas and wherein said plurality of work areas include a mirrored upper surface outwardly extending from said front surface, said upper surface attached to said front surface for pivotal movement about a horizontal pivot axis.

* * * * *